US011289812B2

(12) United States Patent
Wan et al.

(10) Patent No.: US 11,289,812 B2
(45) Date of Patent: Mar. 29, 2022

(54) SINGLE ANTENNA SYSTEM

(71) Applicant: ASUSTeK COMPUTER INC., Taipei (TW)

(72) Inventors: Che-Chi Wan, Taipei (TW); Saou-Wen Su, Taipei (TW); Cheng-Tse Lee, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 17/075,790

(22) Filed: Oct. 21, 2020

(65) Prior Publication Data

US 2021/0126365 A1 Apr. 29, 2021

(30) Foreign Application Priority Data

Oct. 29, 2019 (TW) ..... 108139136

(51) Int. Cl.

| | |
|---|---|
| ***H01Q 1/38*** | (2006.01) |
| ***H01Q 5/35*** | (2015.01) |
| ***H01Q 1/22*** | (2006.01) |
| ***H01Q 9/04*** | (2006.01) |

(52) U.S. Cl.

CPC ..... *H01Q 5/35* (2015.01); *H01Q 1/2283* (2013.01); *H01Q 1/38* (2013.01); *H01Q 9/0407* (2013.01)

(58) Field of Classification Search

CPC ..... H01Q 5/35; H01Q 1/2283; H01Q 1/38; H01Q 9/0407

USPC ..... 343/702

See application file for complete search history.

(56) References Cited

U.S. PATENT DOCUMENTS

| | | | | |
|---|---|---|---|---|
| 9,425,498 | B2 | 8/2016 | Lee et al. | |
| 2011/0050528 | A1 | 3/2011 | Montgomery | |
| 2015/0002348 | A1* | 1/2015 | Wong | H01Q 1/48 343/724 |
| 2021/0167491 | A1* | 6/2021 | Chang | H01Q 5/371 |

FOREIGN PATENT DOCUMENTS

| | | |
|---|---|---|
| CN | 104979636 B | 10/2015 |
| CN | 207426139 U | 5/2018 |

* cited by examiner

*Primary Examiner* — Peguy Jean Pierre

(74) *Attorney, Agent, or Firm* — McClure, Qualey & Rodack, LLP

(57) ABSTRACT

The disclosure provides a single antenna system comprising a ground element, a feeding metal part, at least one shorting metal part, a radiating metal part, a decoupling circuit, a first feed source, and a second feed source. The single antenna system with an integrated decoupled circuit not only effectively achieves size reduction, but achieve high antenna isolation. Moreover, the single antenna system is applied for narrow-bezel notebooks and small-size antenna systems in future.

10 Claims, 6 Drawing Sheets

SINGLE ANTENNA SYSTEM

CROSS-REFERENCE TO RELATED APPLICATION

This application claims the priority benefit of Taiwan application serial No. 108139136, filed on Oct. 29, 2019. The entirety of the above-mentioned patent application is hereby incorporated by reference herein and made a part of specification.

BACKGROUND OF THE INVENTION

Field of the Invention

The disclosure relates to a single antenna system with the same operating frequencies.

Description of the Related Art

Multi-antenna techniques including single-feed and dual-feed antenna designs are widely used in notebooks. The size of a single-feed planar antenna is usually of size 8 mm×40 mm or 10 mm×30 mm. The distance between antenna units of a dual-feed dual antenna system is also maintained at about 0.6 times wavelength of the minimum operating frequency of the antennas to ensure high antenna isolation.

To decrease the distance between the antennas and improve the antenna isolation, decoupling components (such as inductors, capacitors, and resistors), or quarter-wavelength resonant structures are usually configured between the antennas. A dual-antenna system usually includes two separated antenna units without sharing any antenna unit. Decoupling components and resonant structures are independent from the main radiating elements. As a result, the distance between the antenna units is increased due to the decoupling components or the resonant structures, and thus the whole size of the antenna system is increased.

BRIEF SUMMARY OF THE INVENTION

According to an aspect, a single antenna system is provided. The single antenna system comprises: a ground element including a side edge; a feeding metal portion, disposed on the side edge of the ground element, the feeding metal portion including: a first feeding metal portion including a first terminal and a second terminal, the first terminal is adjacent to the ground element; and a second feeding metal portion including a third terminal and a fourth terminal, the third terminal is adjacent to the ground element, the fourth terminal is connected to the second terminal; at least a shorting metal portion connected to the feeding metal portion and the ground element and disposed between the first feeding metal portion and the second feeding metal portion; a radiating metal portion disposed on an outer side of the feeding metal portion away from the ground element and adjacent to the feeding metal portion; a decoupling circuit connected to between the feeding metal portion and the radiating metal portion; a first feed source disposed between the first terminal of the first feeding metal portion and the ground element; and a second feed source disposed between the third terminal of the second feeding metal portion and the ground element.

In sum, the single antenna system in embodiments is a dual-feed single antenna structure with the same operating frequencies. The single antenna system with an integrated decoupled circuit not only effectively achieves size reduction, but achieve high antenna isolation. Moreover, the single antenna system is applied for narrow-bezel notebooks and small-size antenna system in the near future.

These and other features, aspects and advantages of the present invention will become better understood with regard to the following description, appended claims, and accompanying drawings.

DETAILED DESCRIPTION OF THE EMBODIMENTS

Since "full-screen" becomes widely used in notebooks, the bezels around the screen (4~5 mm) are very narrow, and thus the clearance for an antenna system is reduced. Consequently, the antenna for the conventional notebooks is not adapted anymore. In embodiments of the disclosure, a single antenna system with high antenna isolation is applied for narrow-bezel notebooks and meets the requirements for small-size antenna.

Figure 1:
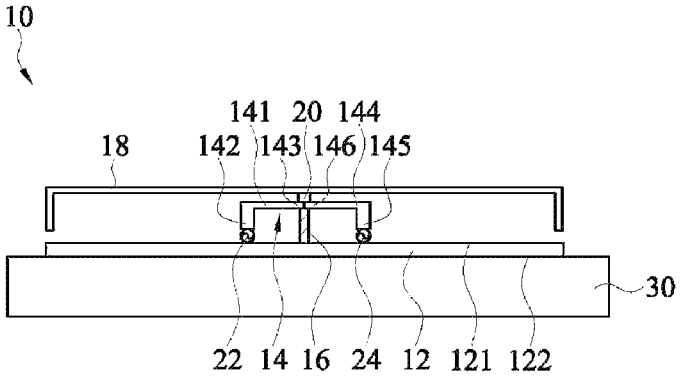
FIG. 1 is a schematic diagram showing a single antenna system according to an embodiment.

The dual-feed single antenna system operating at the same operating frequencies is provided. FIG. 1 is a schematic diagram showing a single antenna system according to an embodiment. As shown in FIG. 1, a single antenna system 10 includes a ground element 12, a feeding metal portion 14, a shorting metal portion 16, a radiating metal portion 18, a decoupling circuit 20, a first feed source 22, and a second feed source 24.

The ground element 12 includes two opposite side edges 121 and 122. The feeding metal portion 14 is configured on the side edge 121 of the ground element 12. The feeding metal portion 14 includes a first feeding metal portion 141 and a second feeding metal portion 144. The first feeding metal portion 141 includes a first terminal 142 and a second terminal 143. The first terminal 142 of the first feeding metal portion 141 is adjacent to the side edge 121 of the ground element 12. The second feeding metal portion 144 includes a third terminal 145 and a fourth terminal 146. The third terminal 145 of the second feeding metal portion 144 is adjacent to the side edge 121 of the ground element 12. The second terminal 143 of the first feeding metal portion 141 is connected to the fourth terminal 146 of the second feeding metal portion 144 to form the feeding metal portion 14. In an embodiment, the feeding metal portion 14 is a "ㄇ" shape metal structure. The first feeding metal portion 141 and the second feeding metal portion 144 are symmetrical metal structures. The first feeding metal portion 141 and the second feeding metal portion 144 form the feeding metal portion 14 with "ㄇ" shape via the connected second terminal 143 and the fourth terminal 146

The shorting metal portion 16 is connected to the feeding metal portion 14 and the ground element 12. That is, the shorting metal portion 16 is located between the first feeding metal portion 141 and the second feeding metal portion 144. A terminal of the shorting metal portion 16 is connected to the second terminal 143 and the fourth terminal 146. The other terminal of the shorting metal portion 16 is connected to the ground element 12. The radiating metal portion 18 is located on an outer side of the feeding metal portion 14 away from the ground element 12, and the radiating metal portion 18 is adjacent to the feeding metal portion 14. Then, the radiating metal portion 18 and the feeding metal portion 14 has a distance there between. The length direction of the radiating metal portion 18 is parallel to that of the feeding metal portion 14.

The decoupling circuit 20 is connected between the feeding metal portion 14 and the radiating metal portion 18. In an embodiment, a terminal of the decoupling circuit 20 is connected to the connection portion between the second terminal 143 of the first feeding metal portion 141 and the fourth terminal 146 of the second feeding metal portion 144. Then, the end of the decoupling circuit 20 is at a center position of the first feeding metal portion 141 and the second feeding metal portion 144. The other terminal of the decoupling circuit 20 is connected to the center position of the radiating metal portion 18. The first feed source 22 is located between the first terminal 142 of the first feeding metal portion 141 and the ground element 12. The second feed source 24 is located between the third terminal 145 of the second feeding metal portion 144 and the ground element 12. The first feed source 22 and the second feed source 24 receive signals with the same frequencies to provide the dual-feed single antenna system 10 of the same operating frequencies.

The side edge 122 of the ground element 12 is connected to a system ground 30. The side edge 122 is connected to a side edge of the system ground 30. In an embodiment, the system ground 30 is an separated metal sheet. In an embodiment, the system ground 30 is attached to a metal surface of an electronic device. In an embodiment, the system ground 30 is a ground portion of a metal casing or a metal portion inside a plastic casing of an electronic device, which is not limited herein. In an embodiment, the electronic device is a notebook, the system ground 30 is the system ground of a notebook screen or a metal portion (such as an EMI aluminum foil or a sputtering metal portion) inside a screen housing of a notebook. In embodiments, the size of the system grounds 30 is changed based on different applications of the single antenna system 10.

In an embodiment, the ground element 12, the feeding metal portion 14 (the first feeding metal portion 141 and the second feeding metal portion 144), the shorting metal portion 16, and the radiating metal portion 18 are made of conductive materials, such as silver, copper, aluminum, iron or other alloys, which is not limited herein.

When the single antenna system 10 transmits or receives signals, the first feed source 22 and the second feed source 24 are fed a same radio frequency signal, respectively, such as 2.4 GHz. The first feeding metal portion 141 and the second feeding metal portion 144 are coupled to excite the radiating metal portion 18 to generate a fundamental mode in a lower frequency band and generate a high-order mode in a higher frequency band. Then, to achieve high isolation between the first feed source 22 and the second feed source 24, the high-order mode and the fundamental mode are adjusted to match with each other via the decoupling circuit 20 and the shorting metal portion 16. As a result, the surface currents to the adjacent signal sources are canceled out, and the isolation between the first feed source 22 and the second feed source 24 in a limited antenna space is enhanced.

Figure 2:
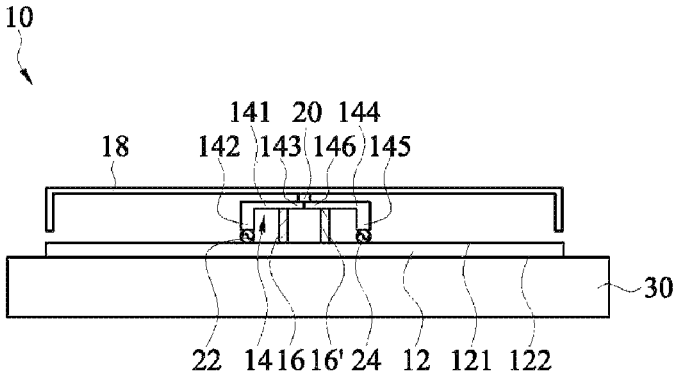
FIG. 2 is a schematic diagram showing a single antenna system according to an embodiment.

FIG. 2 is a schematic diagram showing a single antenna system according to an embodiment. In the single antenna system 10, the shorting metal portions 16 and 16' are disposed between the feeding metal portion 14 and the ground element 12. A terminal of the shorting metal portion 16 is connected to the second terminal 143 of the first feeding metal portion 141. The other terminal of the shorting metal portion 16 is connected to the ground element 12. A terminal of the shorting metal portion 16' is connected to the fourth terminal 146 of the second feeding metal portion 144. The other terminal of the shorting metal portion 16' is connected to the ground element 12. The function of two shorting metal portions 16 and 16' in FIG. 2 is the same as that of the shorting metal portion 16 in FIG. 1 to improve the antenna impedance matching. Other components are similar to those in FIG. 1, which are not described again. In the embodiment, the number of the shorting metal portion is two, which is not limited herein.

Figure 3:
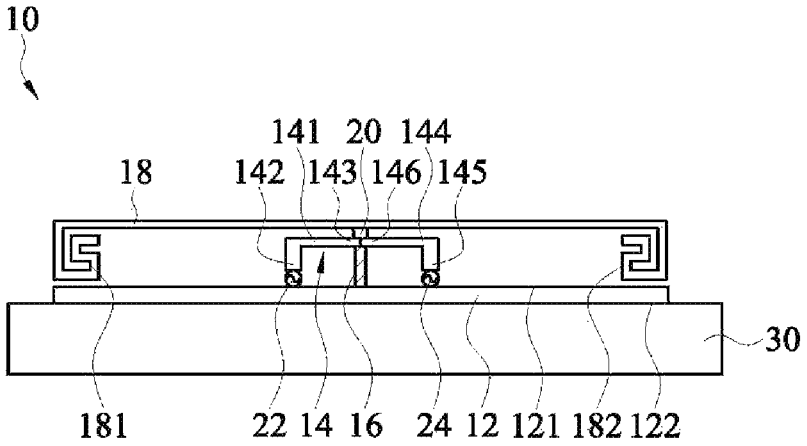
FIG. 3 is a schematic diagram showing a single antenna system according to an embodiment.

FIG. 3 is a schematic diagram showing a single antenna system according to an embodiment. In the single antenna system 10, the radiating metal portion 18 has another shape. Two terminals of the length direction of the radiating metal portion 18 extend inwardly to form folding portions 181, 182. Folding portions 181, 182 are symmetric to each other. Then, the resonant length of the radiating metal portion 18 is increased, and the size of the antenna is reduced effectively. The shapes of the folding portions 181 and 182 are varied according to requirements, which is not limited herein.

Figure 4:
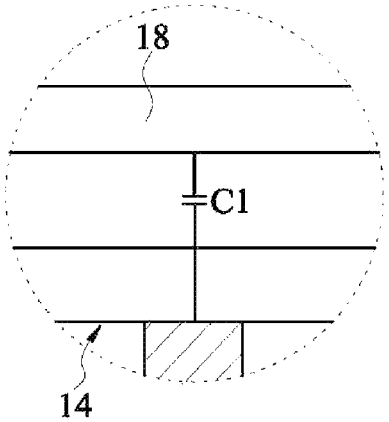
FIG. 4 is a schematic diagram showing a decoupling circuit of a single antenna system according to an embodiment.
Figure 5:
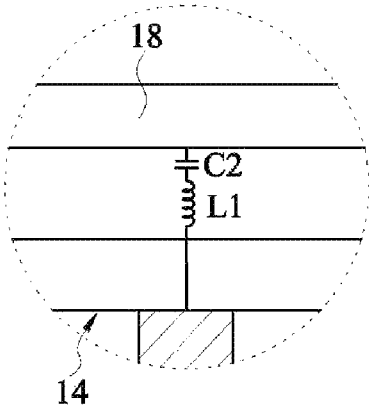
FIG. 5 is a schematic diagram showing a decoupling circuit of a single antenna system according to an embodiment.
Figure 6:
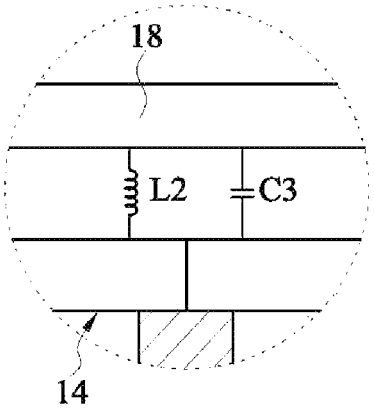
FIG. 6 is a schematic diagram showing a decoupling circuit of a single antenna system according to an embodiment.
Figure 7:
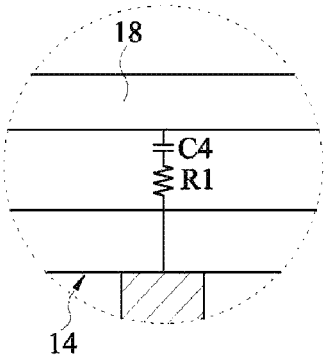
FIG. 7 is a schematic diagram showing a decoupling circuit of a single antenna system according to an embodiment.
Figure 8:
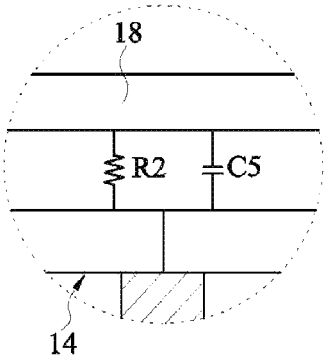
FIG. 8 is a schematic diagram showing a decoupling circuit of a single antenna system according to an embodiment.

FIG. 4 to FIG. 8 are schematic diagrams showing a decoupling circuit of a single antenna system according to embodiments. Please refer to FIG. 1, and FIG. 4 to FIG. 8, the decoupling circuit 20 is a passive component or any combination of passive components to increase the isolation between signal sources (such as the first feed source 22 and the second feed source 24). As shown in FIG. 4, the decoupling circuit 20 is a first capacitor component C1. The first capacitor component C1 is connected between the feeding metal portion 14 and the radiating metal portion 18. As shown in FIG. 5, the decoupling circuit 20 is the second capacitor component C2 and the first inductor component L1 connected in series. The second capacitor component C2 is connected to the radiating metal portion 18. The first inductor component L1 is connected to the feeding metal portion 14. As shown in FIG. 6, the decoupling circuit 20 is the third capacitor component C3 and the second inductor component L2 connected in parallel. The third capacitor component C3 and the second inductor component L2 are connected in parallel and connected between the radiating metal portion 18 and the feeding metal portion 14. As shown in FIG. 7, the decoupling circuit 20 is the fourth capacitor component C4 and the first resistor component R1 connected in series. The fourth capacitor component C4 is connected to the radiating metal portion 18. The first resistor component R1 is connected to the feeding metal portion 14. As shown in FIG. 8, the decoupling circuit 20 is the fifth capacitor component C5 and the second resistor component R2 connected in parallel. The fifth capacitor component C5 and the second resistor component R2 are connected in parallel and connected between the radiating metal portion 18 and the feeding metal portion 14.

Figure 9:
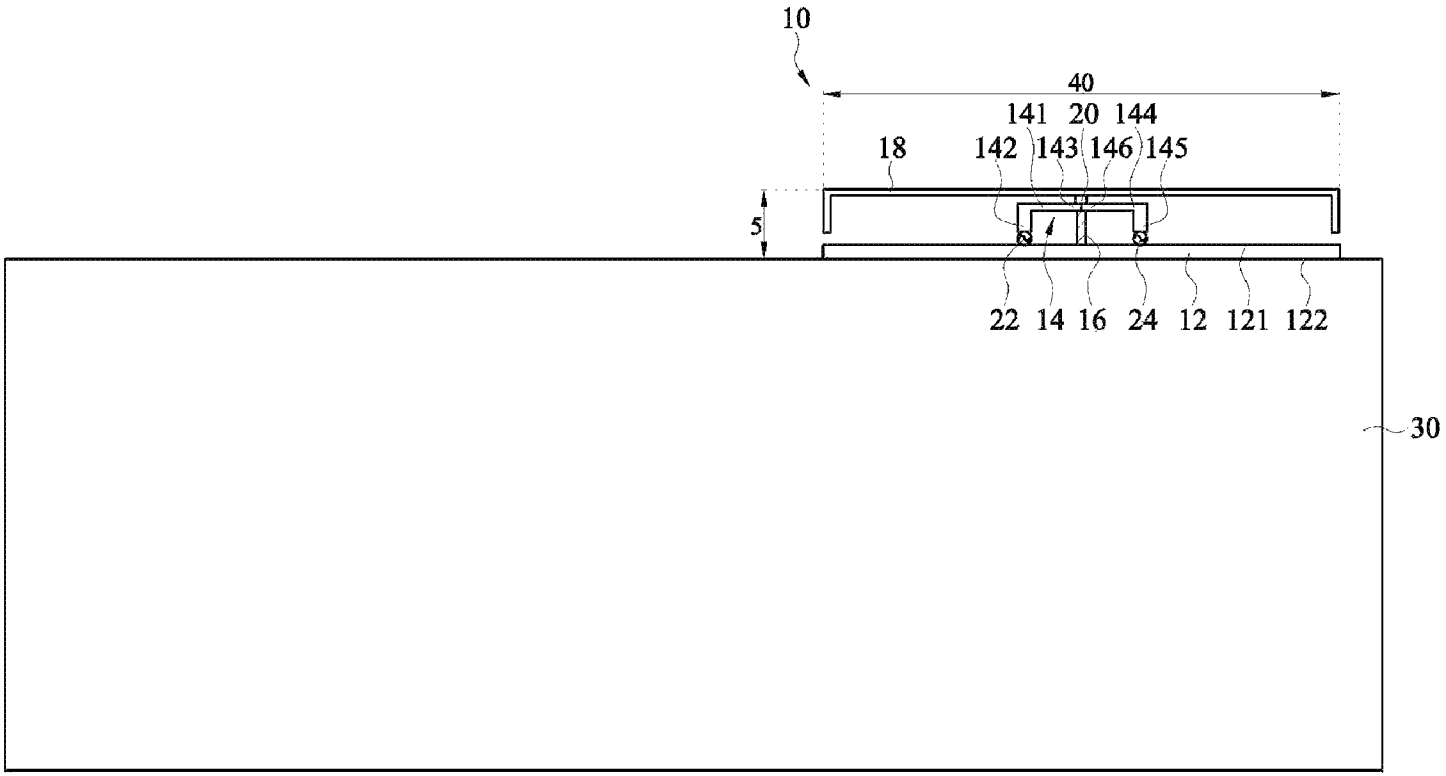
FIG. 9 is a schematic diagram showing a size of a single antenna system according to an embodiment.

FIG. 9 is a schematic diagram showing a size of a single antenna system according to an embodiment. As shown in FIG. 1 and FIG. 9, the length of the single antenna system 10 is 40 mm. The width of the single antenna system 10 is 5 mm. The single antenna system in FIG. 9 is a small-size single antenna system. The single antenna system 10 is on an upper edge of the system ground 30. In the single antenna system 10, the height of the ground element 12 is 1 mm, the length of the ground element 12 is 40 mm, and the area of the ground element 12 is 40 $mm^2$. The feeding metal portion 14 is of an "n" shape. The feeding metal portion 14 includes the first feeding metal portion 141 and the second feeding metal portion 144. The shorting metal portion 16 is between the first feeding metal portion 141 and the second feeding metal portion 144. The width of the shorting metal portion 16 is 0.5 mm. The height of the shorting metal portion 16 is 2.7 mm. The radiating metal portion 18 above the feeding metal portion 14 is of an "n" shape. The width of the radiating metal portion 18 is 0.5 mm. The length of the radiating metal portion 18 is 46 mm. In the embodiment, the decoupling circuit 20 connected between the feeding metal portion 14 and the radiating metal portion 18 is the first capacitor component C1 (as shown in FIG. 4). The capacitance of the first capacitor component C1 is 3.5 pF. The distance between the first feed source 22 and the second feed source 24 is 8 mm.

Figure 10:
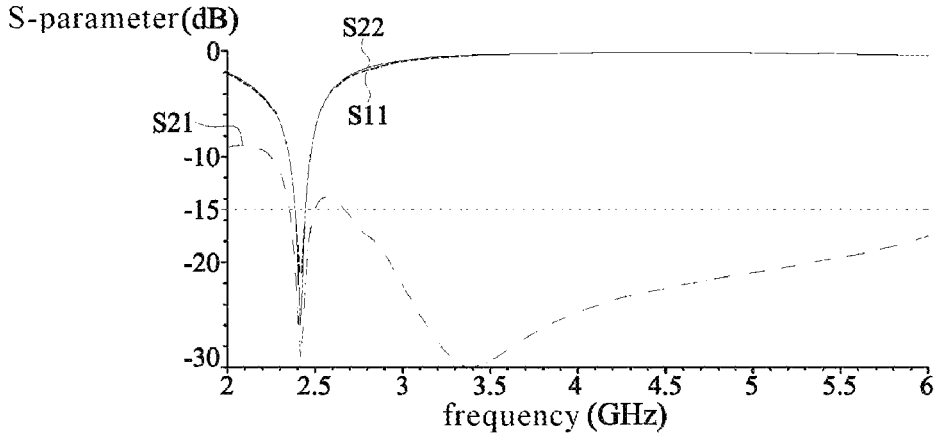
FIG. 10 is a simulation diagram showing S-parameter of a single antenna system according to an embodiment.
Figure 11:
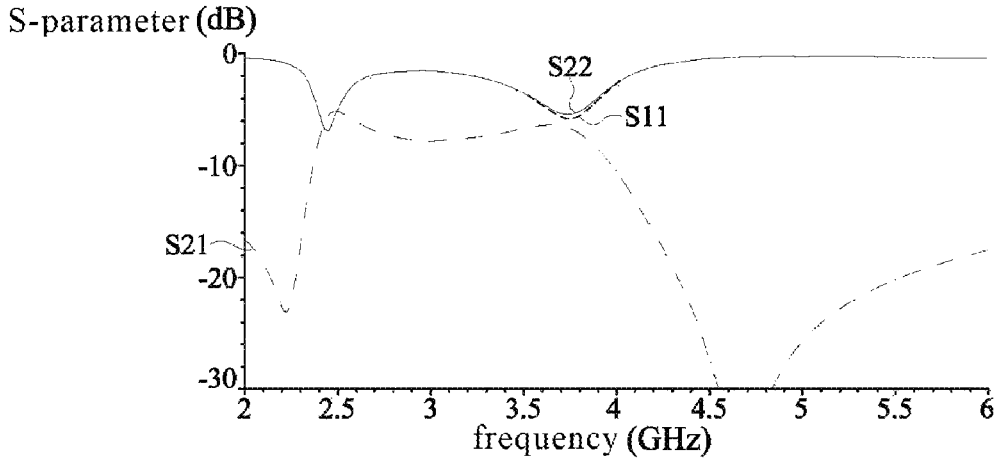
FIG. 11 is a simulation diagram showing S-parameter of a single antenna system without a decoupling circuit according to an embodiment.

FIG. 10 and FIG. 11 are simulation diagrams showing S-parameter of a single antenna system in FIG. 9 transmitting a radio frequency signal according to embodiments. When the single antenna system 10 operates in a low frequency band (for example, the 2.4 GHz band), the S-parameter simulation result is shown in FIG. 10. The isolation curve S21 shows that the isolation is larger than 15 dB (S21<−15 dB) in the 2.4 GHz band, and the reflection coefficients (S11 and S22) of the antennas are lower than −10 dB (S11, S22<−10 dB). That is, the single antenna system 10 has good impedance matching over the operating frequencies while having high isolation. In contrast, when the single antenna system without the decoupling circuit operates in the low frequency band (for example, the 2.4 GHz band) of the same frequencies, the S-parameter simulation result is shown in FIG. 11. The reflection coefficients of the antennas are larger than −7 dB, and the isolation is 5 dB. The isolation is not good. Therefore, the single antenna system 10 in embodiments has high isolation in the frequency band of the dual feed and the same frequencies.

In sum, the single antenna system in embodiments is a dual-feed single antenna structure of the same operating frequencies. The single antenna system with an integrated decoupled circuit not only effectively achieves size reduction, but achieve high antenna isolation. Moreover, the single antenna system is applied for narrow-bezel notebooks and small-size antenna systems in future.

Although the present invention has been described in considerable detail with reference to certain preferred embodiments thereof, the disclosure is not for limiting the scope of the invention. Persons having ordinary skill in the art may make various modifications and changes without departing from the scope. Therefore, the scope of the appended claims should not be limited to the description of the preferred embodiments described above.

What is claimed is:

1. A single antenna system, comprising:

a ground element, including a side edge;

a feeding metal portion, disposed on the side edge of the ground element, and the feeding metal portion includes:

a first feeding metal portion, including a first terminal and a second terminal, the first terminal is adjacent to the ground element; and a second feeding metal portion, including a third terminal and a fourth terminal, the third terminal is adjacent to the ground element, the fourth terminal is connected to the second terminal;

at least a shorting metal portion, connected to the feeding metal portion and the ground element and disposed between the first feeding metal portion and the second feeding metal portion;

a radiating metal portion, disposed on an outer side of the feeding metal portion away from the ground element and adjacent to the feeding metal portion;

a decoupling circuit, connected to between the feeding metal portion and the radiating metal portion;

a first feed source, disposed between the first terminal of the first feeding metal portion and the ground element; and a second feed source disposed between the third terminal of the second feeding metal portion and the ground element.

2. The single antenna system according to claim 1, wherein the ground element is connected to a system ground.

3. The single antenna system according to claim 1, wherein the first feeding metal portion and the second feeding metal portion are symmetrical metal structures.

4. The single antenna system according to claim 3, wherein the feeding metal portion is of an "⊓" shape.

5. The single antenna system according to claim 1, wherein a length direction of the radiating metal portion is parallel to the length direction of the feeding metal portion.

6. The single antenna system according to claim 1, wherein two terminals of the radiating metal portion extend inwardly to form folding portions.

7. The single antenna system according to claim 1, wherein the decoupling circuit is a passive element or a combination of passive components.

8. The single antenna system according to claim 7, wherein the decoupling circuit is a first capacitor component, a second capacitor component and a first inductor component connected in series, a third capacitor component and a second inductor component connected in parallel, a fourth capacitor component and a first resistor component connected in series, or a fifth capacitor component and a second resistor component connected in parallel.

9. The single antenna system according to claim 1, wherein a terminal of the decoupling circuit is disposed between the first feeding metal portion and the second feeding metal portion, and the other terminal is connected to a center position of the radiating metal portion.

10. The single antenna system according to claim 1, wherein the first feed source and the second feed source receive a signal source of the same frequencies.

* * * * *